US012345096B2

(12) United States Patent
Morin et al.

(10) Patent No.: US 12,345,096 B2
(45) Date of Patent: Jul. 1, 2025

(54) EARTH-BORING TOOLS, NOZZLES, AND ASSOCIATED STRUCTURES, APPARATUS, AND METHODS

(71) Applicant: Baker Hughes Oilfields Operations, Inc., Houston, TX (US)

(72) Inventors: John Morin, The Woodlands, TX (US); Xu Huang, Spring, TX (US); Ahmed Hanafy, The Woodlands, TX (US)

( * ) Notice: Subject to any disclaimer, the term of this patent is extended or adjusted under 35 U.S.C. 154(b) by 0 days.

(21) Appl. No.: 18/530,516

(22) Filed: Dec. 6, 2023

(65) Prior Publication Data

US 2025/0188806 A1 Jun. 12, 2025

(51) Int. Cl.
*E21B 10/18* (2006.01)
*E21B 10/60* (2006.01)
*E21B 10/61* (2006.01)

(52) U.S. Cl.
CPC ..... *E21B 10/18* (2013.01); *E21B 10/60* (2013.01); *E21B 10/61* (2013.01)

(58) Field of Classification Search
CPC ..... E21B 10/18; E21B 10/61; E21B 10/60; B23K 31/02; B23K 2101/002; C22F 1/006
See application file for complete search history.

(56) References Cited

U.S. PATENT DOCUMENTS 4,303,136 A 12/1981 Ball
4,381,825 A 5/1983 Radtke
4,603,750 A * 8/1986 Sorenson ..... E21B 10/62 175/393
4,711,311 A 12/1987 Underwood et al.
5,906,245 A 5/1999 Tibbitts et al.
6,390,211 B1 5/2002 Tibbitts
7,481,284 B2 1/2009 Wells et al.
7,681,668 B2 3/2010 Oxford et al.
7,954,568 B2 6/2011 Bilen
9,033,066 B2 5/2015 Gavia
9,803,428 B2 10/2017 Matthews, III
10,053,916 B2 8/2018 Yu et al.
10,871,039 B2 * 12/2020 Maw ..... E21B 10/602
11,098,533 B2 8/2021 Matthews, III
2008/0053708 A1 3/2008 Oxford
(Continued)

FOREIGN PATENT DOCUMENTS

CN 2386181 7/2000
WO 2008/121219 A1 10/2008
WO 2010/088233 A2 8/2010

OTHER PUBLICATIONS

Bomidi et al., Earthboring Tools, Nozzles, and Associated Structures, Apparatus, and Methods, PCT Application No. PCT/US2023/073210 filed Aug. 31, 2023.
(Continued)

*Primary Examiner* — Yong-Suk (Philip) Ro
(74) *Attorney, Agent, or Firm* — Baker Hughes Company

(57) ABSTRACT

A nozzle or use in an earth-boring tool includes an inlet having a first size. The nozzle further includes an outlet having a second size different from the first size of the inlet. The nozzle also includes a fluid passage defined in the nozzle from the inlet to the outlet. The fluid passage includes a transition region configured to transition the fluid passage from the first size of the inlet to the second size of the outlet. The transition region includes a first arc curving inward and a second arc curving outward.

17 Claims, 8 Drawing Sheets

(56) References Cited

U.S. PATENT DOCUMENTS

| | | | | |
|---|---|---|---|---|
| 2008/0110680 | A1 | 5/2008 | Bilen | |
| 2009/0321145 | A1* | 12/2009 | Fisher | B22F 3/162 419/18 |
| 2010/0193253 | A1 | 8/2010 | Massey et al. | |
| 2020/0217144 | A1 | 7/2020 | Maw | |
| 2022/0213735 | A1 | 7/2022 | Lane et al. | |

OTHER PUBLICATIONS

International Search Report for Application No. PCT/US2024/056454 dated Feb. 24, 2025, 3 pages.
International Written Opinion for Application No. PCT/US2024/056454 dated Feb. 24, 2025, 4 pages.

* cited by examiner

EARTH-BORING TOOLS, NOZZLES, AND ASSOCIATED STRUCTURES, APPARATUS, AND METHODS

TECHNICAL FIELD

Embodiments of the present disclosure generally relate to earth-boring operations. In particular, embodiments of the present disclosure relate to earth-boring tools, nozzles, and associated structures, apparatus, and methods.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

A fluid may be supplied into the wellbore during the wellbore drilling operation. The fluid may be used to cool and/or clean the earth-boring tool and/or related cutting elements. For example, the fluid may cool the earth-boring tool and carry cuttings and debris away from the earth-boring tool. Fluid pressure in the wellbore may be controlled to different pressures for different types of drilling operations. For example, in overbalanced drilling, the fluid pressure in the wellbore may be maintained above the pressure of the fluid in the earth formation to substantially prevent ingress of the fluids from the formation into the wellbore during the drilling operation. In some cases, the fluid pressure in the wellbore may be maintained below the fluid pressure of the formation. Lower fluid pressures may increase the efficiency of the drilling operation, however, this may allow fluid from the formation to enter the wellbore.

BRIEF SUMMARY

Embodiments of the disclosure include a nozzle for use in an earth-boring tool. The nozzle includes an inlet having a first size. The nozzle further includes an outlet having a second size different from the first size of the inlet. The nozzle also includes a fluid passage defined in the nozzle from the inlet to the outlet. The fluid passage includes a transition region configured to transition the fluid passage from the first size of the inlet to the second size of the outlet. The transition region includes a first frustoconical surface exhibiting a first arcuate shape curving inward; and a second frustoconical surface exhibiting a second arcuate shape curving outward.

Another embodiment of the disclosure includes an earth-boring tool. The earth-boring tool includes at least one blade including at least one cutting element. The earth-boring tool further includes at least one fluid course positioned adjacent the at least one blade. The earth-boring tool also includes a nozzle positioned in the at least one fluid course. The nozzle includes an inlet having a first size. The nozzle further includes an outlet having a second size different from the first size of the inlet. The nozzle also includes a fluid passage defined in the nozzle from the inlet to the outlet. The fluid passage includes a transition region configured to transition the fluid passage from the first size of the inlet to the second size of the outlet. The transition region includes an inlet transition point where a cross-section of the fluid passage begins to transition from the first size of the inlet. The transition region further includes an outlet transition point, where the cross-section of the fluid passage finishes transitioning to the second size of the outlet. The transition region also includes a transition length defined between the inlet transition point and the outlet transition point, where the transition length is between about ¼ and about ¾ of a total length of the fluid passage.

Other embodiments of the disclosure include a method of forming a nozzle for an earth-boring tool. The method includes forming a nozzle structure including an interface structure and an extension extending from the interface structure. The method further includes forming an inlet in the nozzle structure having a first size. The method also includes forming an outlet in the nozzle structure axially aligned with the inlet, the outlet having a second size different from the first size. The method further includes forming a fluid passage between the inlet and the outlet, the fluid passage extending axially through the nozzle structure. The method also includes forming a transition region in the fluid passage, the transition region configured to transition the fluid passage from the first size of the inlet to the second size of the outlet. The transition region includes a first frustoconical surface defining a first arc curving inward and a second frustoconical surface defining second arc curving outward.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
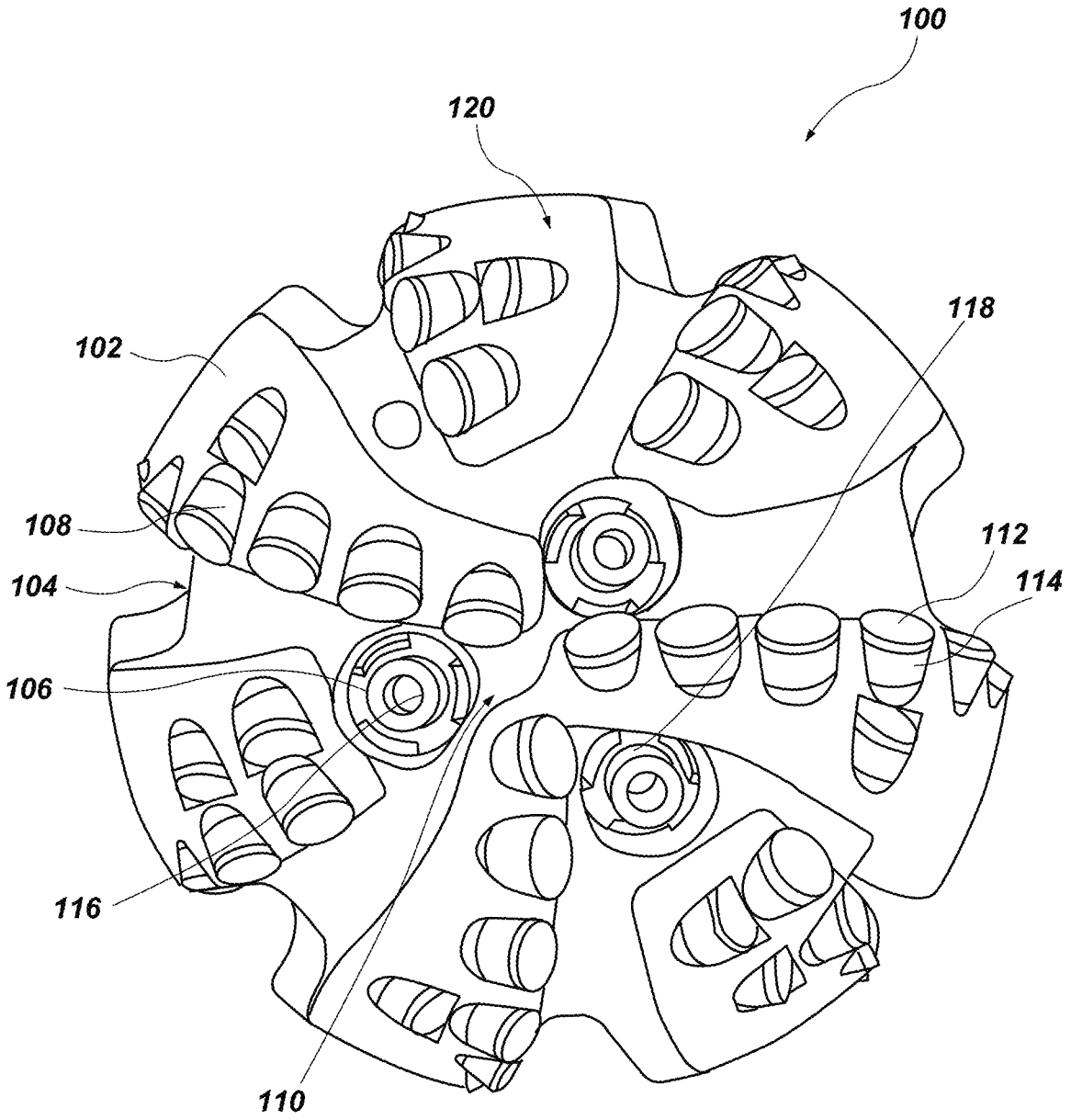
FIG. 1 illustrates a front view of an earth-boring tool in accordance with embodiments of the disclosure.

The illustrations presented herein are not meant to be actual views of any particular earth-boring system or component thereof, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met. In another example, an angle that is substantially met may be within about +/−15°, within about +/−10°, within about +/−5°, or even within about 0°.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the terms "vertical" and "lateral" refer to the orientations as depicted in the figures.

During a drilling operation fluid may be supplied into the wellbore to cool and/or clean the earth-boring tool and related cutting elements. The pressure of the fluid in the wellbore may be used to substantially prevent reservoir fluids (e.g., fluids stored in the formation, such as gas, oil, water, etc.) from entering the wellbore during the drilling operation, this is commonly referred to as overbalance drilling. High fluid pressure in the wellbore may reduce the efficiency of the drilling operation. For example, maintaining the fluid pressure above the pressure of the reservoir fluids may increase the strength of the formation near the wall of the wellbore. The increased strength of the formation may reduce the efficiency of the drilling operation by reducing the cutting depth and rate of penetration (ROP) of the earth-boring tool.

Figure 2:
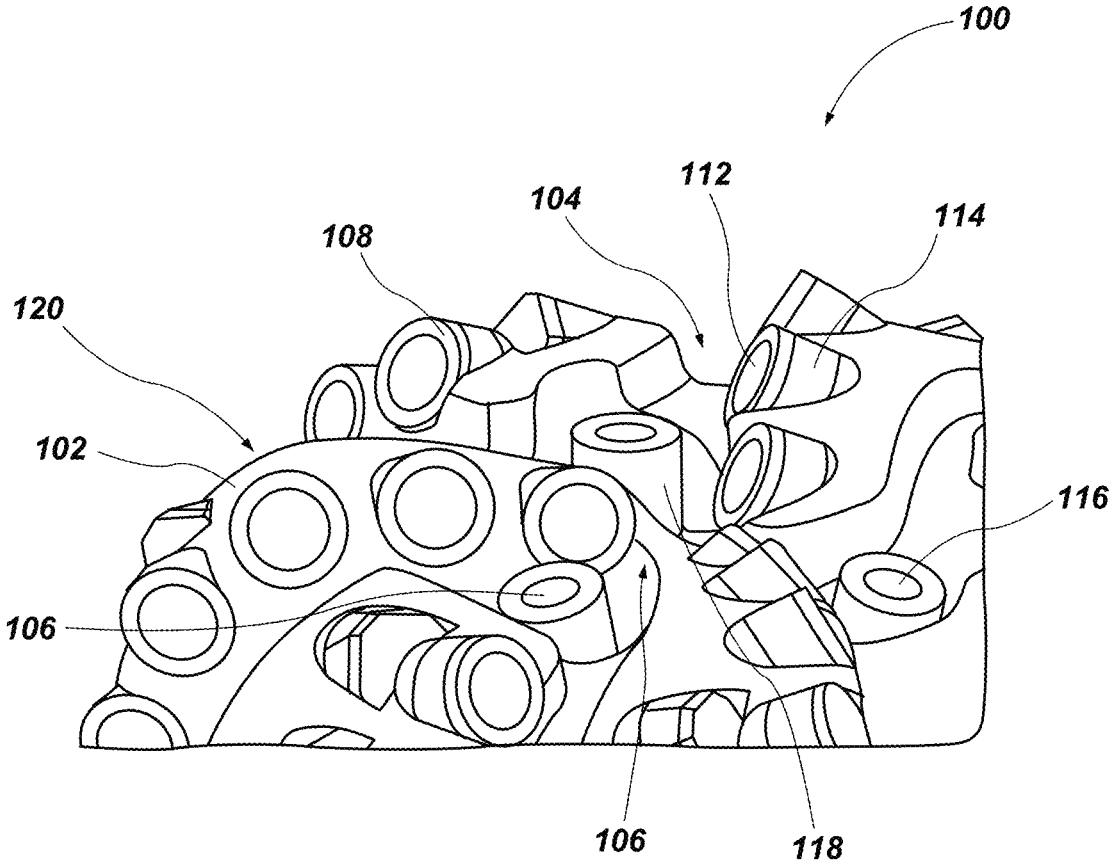
FIG. 2 illustrates an enlarged view of a portion of the earth-boring tool of FIG. 1.

FIGS. 1 and 2, are views of an earth-boring tool 100. The earth-boring tool 100 includes blades 102 in which a plurality of cutting elements 108 are secured. The cutting elements 108 include a cutting table defining a cutting face 112 which may form the cutting edge of the blade 102. The cutting elements 108 also include a substrate 114 configured to support the cutting table. The substrate 114 may be secured to a cutting pocket in the blade 102, such as through welding, soldering, brazing, etc., securing the cutting elements 108 to the blade 102.

The earth-boring tool 100 may rotate about a longitudinal axis of the earth-boring tool 100. When the earth-boring tool 100 rotates, the cutting face 112 of the cutting elements 108 may contact the earth formation and remove material. The material removed by the cutting faces 112 may then be removed through the fluid courses 104, in the industry the portion of the fluid courses 104 in a gage region of the earth-boring tool 100 are commonly referred to as junk slots. The earth-boring tool 100 includes nozzles 106 which may introduce fluid, such as water or drilling mud, into the area around the blades 102 to aid in removing the sheared material and other debris from the area around the blades 102 and/or to cool the cutting elements 108 and the blade 102 to increase the efficiency of the earth-boring tool 100.

The fluid may enter the wellbore through the nozzles 106. The nozzles 106 may be coupled to a pressurized fluid supplied through the drill string. The pressure of the fluid in the borehole may be controlled through the pressure of the fluid being supplied through the drill string and the nozzles 106. Reducing a distance between the nozzles 106 and a formation may facilitate weakening the material of the formation by infiltrating pores in the formation material with the fluid. In some embodiments, the nozzles 106 are configured to concentrate fluid flowing through the nozzles 106 through a jetting effect that may increase a pressure of the fluid contacting the formation and may weaken the material of the formation. For example, a formation's bulk strength may increase at greater depths due to a confining pressure. Delivering a high-pressure fluid directly onto the formation may locally weaken the bulk strength of the formation and cuttings, which may increase the amount of material removed, depth of cut, and/or rate of penetration of the associated earth-boring tool 100.

The nozzles 106 of the earth-boring tool 100, may be concentrated near a nose region 110 of the earth-boring tool 100. Positioning the nozzles 106 near the nose region 110 of the earth-boring tool 100 may facilitate reducing the strength of the formation immediately ahead of the earth-boring tool 100 during a drilling operation. In some embodiments, one or more of the nozzles 106 are directed to a shoulder region 120. In other embodiments, the nozzles 106 may be directed to both the nose region 110 and the shoulder region 120. In each configuration, the cutting elements 108 in the respective nose region 110 and/or shoulder region 120 may pass through a pressurized region of the formation where the mechanical cutting forces are reduced, which may result in an increased depth of cut, or rate of penetration.

In some embodiments, the nozzles 106 are positioned within the fluid courses 104 of the earth-boring tool 100. The nozzles 106 may include an extension 118 configured to position an outlet 116 of the nozzles 106 near the cutting elements 108 on an adjacent blade 102. For example, the extension 118 may position the outlet 116 within a cutting path of the cutting elements 108 defined by the circumference of the cutting faces 112 of the adjacent cutting elements 108. The extension 118 may extend away from a base of the associated fluid course 104 such that the outlet 116 is positioned close to the formation.

Figure 3:
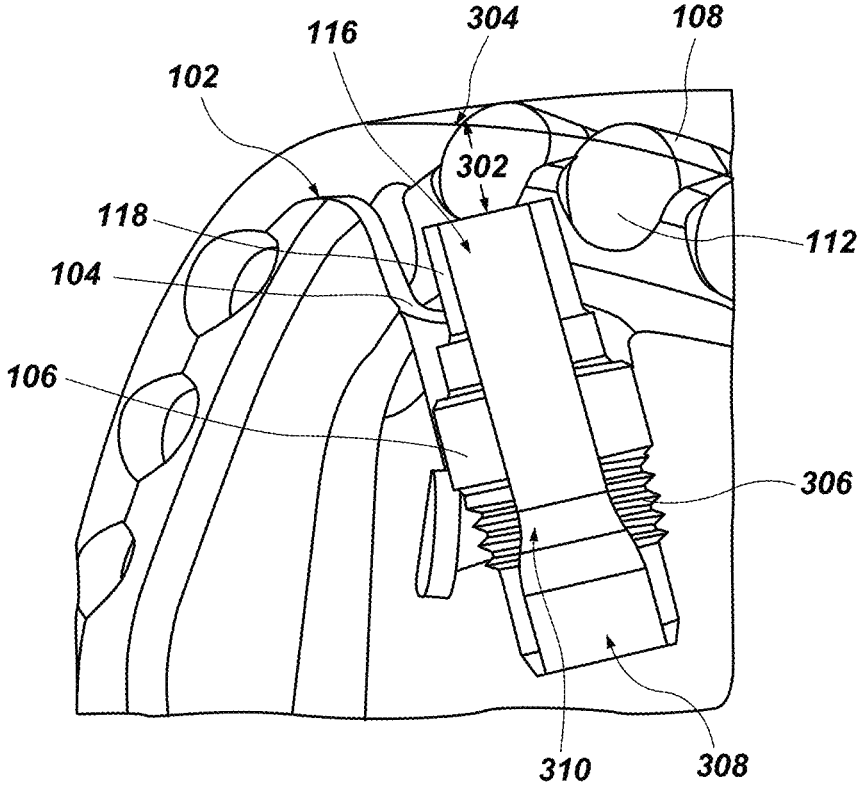
FIG. 3 illustrates an enlarged cross-sectional view of the earth-boring tool of FIGS. 1 and 2.

FIG. 3 illustrates an enlarged cross-section of the earth-boring tool 100 where the nozzle 106 is coupled to the earth-boring tool 100 in a fluid course 104. The extension 118 of the nozzle 106 may position the outlet 116 a distance 302 from a cutting edge 304 of the adjacent cutting elements 108. The distance 302 may facilitate the fluid leaving the outlet 116 to imping on the formation at a high velocity while maintaining a distance between the formation and the nozzle 106, such that the nozzle 106 may not contact the formation or be covered by debris from the formation. The distance 302 may substantially prevent the outlet 116 from being damaged by contact with the formation or from being clogged with debris from the formation. The distance 302 may be in a range from about 0.5 inches (12.7 mm) to about 0.25 inches (6.35 mm), such as from about 0.4 inches (10.16 mm) to about 0.3 inches (7.62 mm), or about 0.375 inches (9.53 mm).

The nozzle 106 may be secured to the earth-boring tool 100 through an interface 306. The interface 306 may include interlocking threads that may facilitate removal, replacement, and/or changing the nozzle 106. In some embodiments, the interlocking threads of the interface 306 are tapered threads, such as pipe threads (e.g., NPT threads) that may form a substantially fluid tight seal when the nozzle 106 is tightened into place. In other embodiments, the interlocking threads of the interface may be straight threads. In some cases a secondary seal, such as an O-ring, may be positioned between the nozzle 106 and a surface of the earth-boring tool 100, such that when the nozzle 106 is tightened into place, the secondary seal is compressed between the nozzle 106 and the earth-boring tool 100 to form a substantially fluid tight seal. The secondary seal may be formed from a material having a high durometer (e.g., in a range from about 80 to about 90). The high durometer may facilitate forming a substantially fluid tight seal at fluid pressures in excess of 1500 psi. Drilling operations in different types of formations may be benefited by different sizes of outlets 116 on the nozzles 106. For example, a smaller outlet 116 may increase a velocity of the fluid leaving the nozzle 106, which may improve the penetration into formation materials having smaller pores, such as shale. Alternatively, a larger outlet 116 may increase the volume of fluid while reducing the velocity of the fluid, which may facilitate penetration of a larger amount of fluid into a more porous formation material, such as sandstone.

The nozzle 106 may include an inlet 308 on an opposite end of the nozzle 106 from the outlet 116. The inlet 308 may be coupled to fluid paths through the earth-boring tool 100, which may direct fluid from the drill string to the nozzles 106. The nozzle 106 may include a neck 310 positioned between the inlet 308 and the outlet 116. The neck 310 may reduce a cross-sectional diameter of the fluid path through the nozzle 106 from the size of the inlet 308 to at least the size of the outlet 116. Reducing the cross-sectional diameter of the fluid path through the nozzle 106 may provide a jetting effect accelerating the fluid passing through the nozzle 106, such that the fluid leaving the nozzle 106 through the outlet 116 is traveling at a higher rate of speed than the fluid entering the nozzle 106 through the inlet 308. The distance between the neck 310 and the outlet 116 may facilitate a stabilization of the speed of the fluid, such that the fluid exiting the outlet 116 may flow at a substantially uniform velocity greater than the velocity of the fluid entering the nozzle 106 through the inlet 308.

Figure 4A:
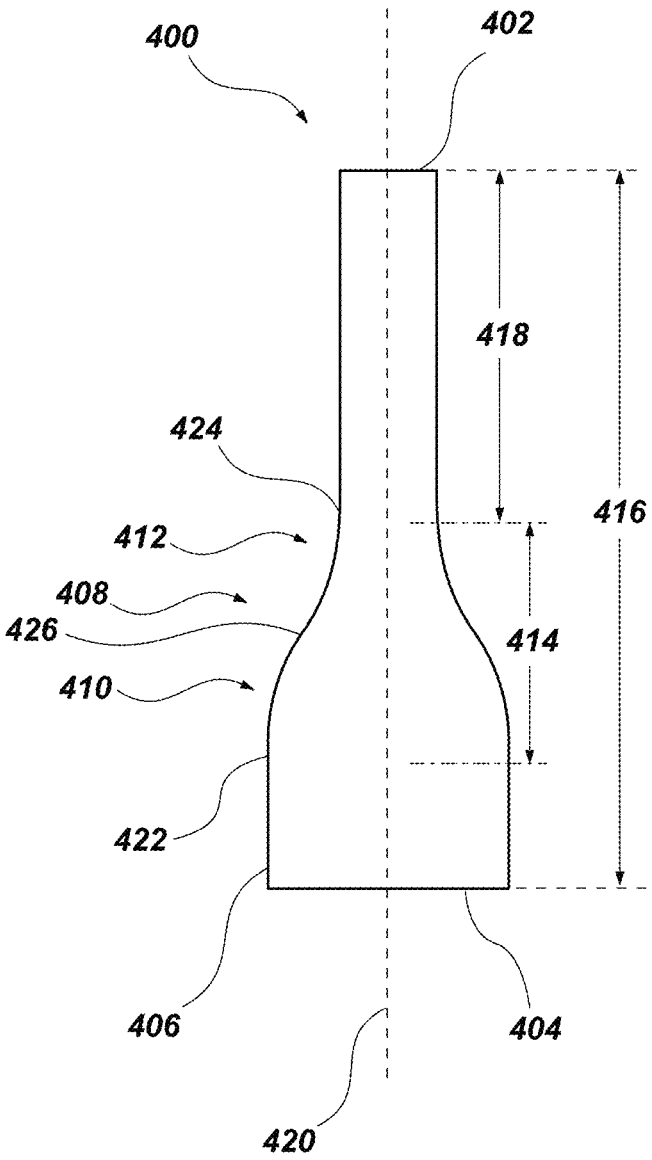
FIGS. 4A and 4B illustrate schematic views of embodiments of a fluid passage through a nozzle in accordance with embodiments of the disclosure.
Figure 4B:
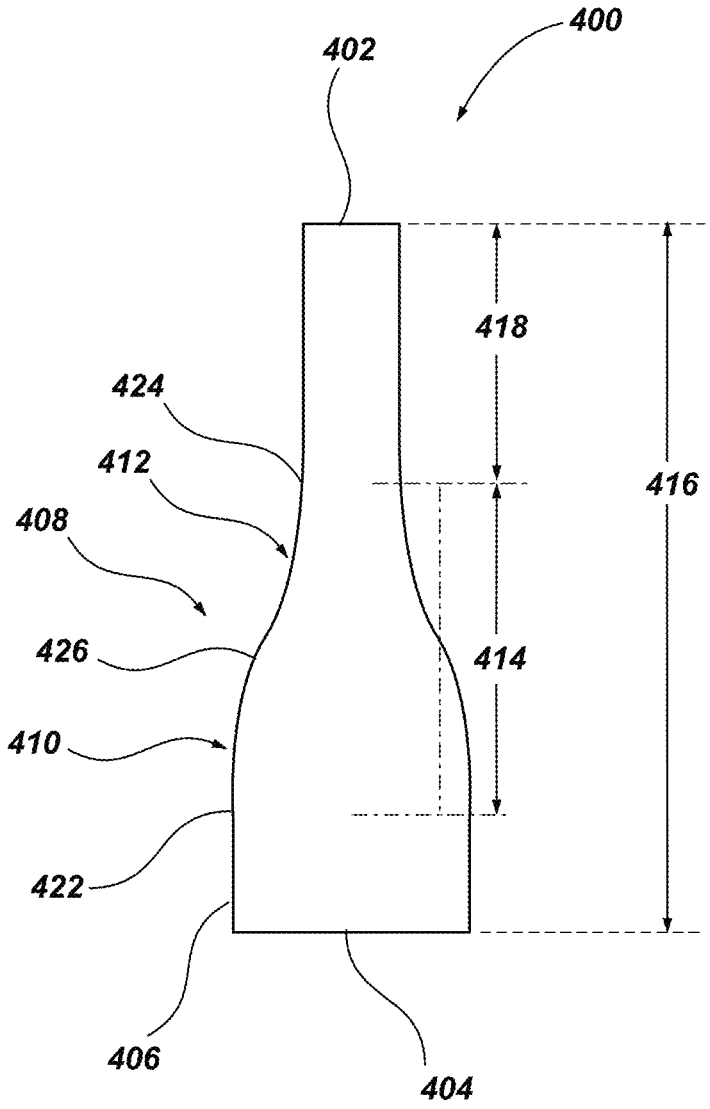

FIG. 4A and FIG. 4B illustrate schematic views of different embodiments of a fluid passage 400 through a nozzle, such as a fluid passage 400 through one or more of the nozzles 106 illustrated in FIGS. 1-3. The fluid passage 400 extends from an inlet 404 to an outlet 402, which are axially aligned along a longitudinal axis 420 of the fluid passage 400. As discussed above, the inlet 404 and the outlet 402 may be different sizes or shapes. For example, a major dimension (e.g., radius, apothem, width, etc.) of the outlet 402 may be smaller than a major dimension of the inlet 404. The fluid passage 400 may be defined by a substantially cylindrical wall 406. Thus, the schematic views of FIG. 4A and FIG. 4B are representative of a cross-sectional view of the fluid passage 400 defined by the wall 406.

The fluid passage 400 may include a transition region 408 configured to transition from the size and/or shape of the inlet 404 to the size and/or shape of the outlet 402. The transition region 408 may include one or more features configured to contract the fluid passage 400 from the size and/or shape of the inlet 404 to the size and/or shape of the outlet 402, such as a funnel shape (e.g., a straight funnel or curved funnel). A straight funnel shape may have substantially straight sides forming a conical structure in the transition region 408. A curved funnel may include one or more curved converging surfaces defining a curved funnel shape in the transition region 408. The nozzles (e.g., nozzle 106 (FIGS. 1-3)) may be formed through processes, such as forging processes, machining processes, or sintering processes. In other embodiments, additive manufacturing (e.g., 3-D printing) may be used. For example, additive manufacturing may facilitate forming increasingly complex shapes in the transition region 408 that may facilitate improved flow properties and improved flow control. In some examples, additive manufacturing may be used directly to form the nozzles. In other examples, additive manufacturing may be used to form molds that may then be used in a subsequent process, such as forging or sintering to form the nozzles.

The transition region 408 illustrated in the embodiment of FIGS. 4A and 4B are both curved funnel transitions. The curved funnel is formed by a first frustoconical surface defining a first arc 410 (e.g., exhibiting first acuate shape) in a longitudinal cross-sectional plane configured to curve inward (e.g., toward the longitudinal axis 420 of the fluid passage 400) and a second frustoconical surface defining a second arc 412 (e.g., exhibiting second acuate shape) in a longitudinal cross-sectional plane configured to curve outward (e.g., away from the longitudinal axis 420 of the fluid passage 400). In some embodiments, the first arc 410 has a first radius that is substantially the same as a second radius of the second arc 412. In other embodiments, the first radius of the first arc 410 and the second radius of the second arc 412 are different. For example, the first radius of the first arc 410 may be larger than the second radius of the second arc 412. In another example, the first radius of the first arc 410 may be smaller than the second radius of the second arc 412.

A ratio of the size of the outlet 402 (e.g., radius of the outlet 402) to the first radius of the first arc 410 (e.g., the first radius of the first arc 410/the radius of the outlet 402) and the second radius of the second arc 412 (e.g., the second radius of the second arc 412/the radius of the outlet 402) may be in a range from about 2 to about 10, such as from about 4 to 9, or about 6 to about 8. For example, for an outlet having a diameter of about 0.25 inches (radius of about 0.125 in) the first radius of the first arc 410 and the second radius of the second arc 412 may each be about 1 in.

The transition region 408 may include multiple transition points in the wall 406 where two different geometric features defined by the wall 406 meet. At each transition point the joining geometric features may be substantially tangential to one another, such that the wall 406 at the transition point is substantially smooth with no abrupt geometric changes. In the embodiment illustrated in FIG. 4A, the transition region 408 includes three transition points, an inlet transition point 422, an intermediate transition point 426, and an outlet transition point 424. The inlet transition point 422 is a point where the fluid passage 400 begins to transition from the size of the inlet 404 (e.g., a major cross-sectional dimension of the fluid passage 400 on a first side of the inlet transition point 422 and immediately adjacent to the inlet transition point 422 is substantially the same as a major cross-sectional dimension of the inlet 404 and a major cross-sectional dimension of the fluid passage 400 on a second opposite side of the inlet transition point 422 and immediately adjacent to the inlet transition point 422 is a different size from the major cross-sectional dimension of the inlet 404). The outlet transition point 424 is a point where the fluid passage 400 finishes transitioning to the second size of the outlet 402 (e.g., a major cross-sectional dimension of the fluid passage 400 on a first side of the outlet transition point 424 and immediately adjacent to the outlet transition point 424 is substantially the same as a major cross-sectional dimension of the outlet 402 and a major cross-sectional dimension of the fluid passage 400 on a second opposite side of the outlet transition point 424 and immediately adjacent to the outlet transition point 424 is a different size from the major cross-sectional dimension of the outlet 402). The intermediate transition point 426 is a point where the first arc 410 of the first frustoconical surface and the second arc 412 of the second frustoconical surface meet (e.g., a transition point between the first arc 410 and the second arc 412). The radii and length of the associated first arc 410 of the first frustoconical surface and the second arc 412 of the second frustoconical surface may be selected to maintain the tangential relationship between the first arc 410 of the first frustoconical surface and the second arc 412 of the second frustoconical surface at the intermediate transition point 426 as well as the tangential relationships between the wall 406 extending from the inlet 404 and the first arc 410 at the inlet transition point 422 and between the second arc 412 and the wall 406 extending to the outlet 402 at the outlet transition point 424.

The distance between the inlet transition point 422 and the outlet transition point 424 defines a transition length 414. The embodiments illustrated in FIGS. 4A and 4B, illustrated two embodiments of fluid passages 400 having different transition lengths 414. Increasing the transition length 414 may result in improvements to the fluid flow at the outlet 402. For example, increasing the transition length 414 may reduce pressure losses through across the transition region 408, such that higher pressures may be achieved at the outlet 402. Increasing the transition length 414 may also result in higher flow velocities at the outlet 402. The transition length 414 may be increased by increasing the radius of one or more of the arcs 410, 412. For example, if both the first arc 410 and the second arc 412 have radii of about 1 in., the transition length 414 may be about 0.845 in long to maintain the tangential relationships at each of the transition points 422, 424, 426. If both the first arc 410 and the second arc 412 have radii of about 0.5 in., the transition length 414 may be about 0.583 in long to maintain the tangential relationships at each of the transition points 422, 424, 426. The transition length 414 may constitute between ¼ and about ¾ of a total length 416 of the fluid passage 400. For example, the transition length 414 may be in a range from about ¼ of the total length 416 and about ¾ of the total length 416, such as from about ⅓ of the total length 416 and about ½ of the total length 416.

The fluid passages 400 may also include an outlet length 418 defining the distance between the outlet transition point 424 and the outlet 402. The fluid passage 400 in the outlet length 418 may have a substantially uniform cross-section having substantially a same size and shape as the outlet 402. The walls 406 between the outlet transition point 424 and the outlet length 418 may be configured to stabilize the fluid flow after the flow passes through the transition region 408. Increasing the outlet length 418 may provide greater stability to the fluid flow exiting the fluid passage 400 through the outlet 402. Increasing the outlet length 418 may also increase pressure losses in the fluid passage 400. The outlet length 418 may be determined based on a major dimension of the outlet 402. For example, the outlet length 418 may be in a range from about 1 times the diameter of the outlet 402 to about 5 times the diameter of the outlet 402, such as from about 1 times the diameter of the outlet 402 to about 3 times the diameter of the outlet 402.

In the embodiments of the nozzles 106 illustrated in FIGS. 1 and 2, the outlet 116 (e.g., outlet 402) of the nozzles 106 are circular in shape. Therefore, the associated fluid passage 400 of the nozzle 106 would have a substantially circular cross section in a direction perpendicular to the longitudinal axis 420 of the fluid passage 400. In other embodiments, the outlet 402 of the fluid passage 400 may have other non-circular shapes, such as oval shapes, triangular shapes, rectangular shapes, or non-symmetrical shapes. The different shapes of the outlet 402 may be selected to provide a desired impact pattern at the formation for the fluid exiting the fluid passage 400.

Figure 5A:
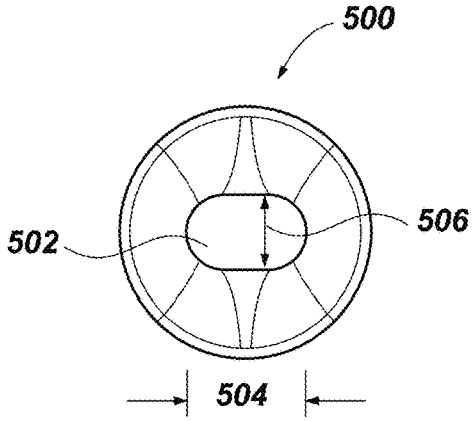
FIG. 5A illustrates a front schematic view of a fluid passage through a nozzle in accordance with embodiments of the disclosure.
Figure 5B:
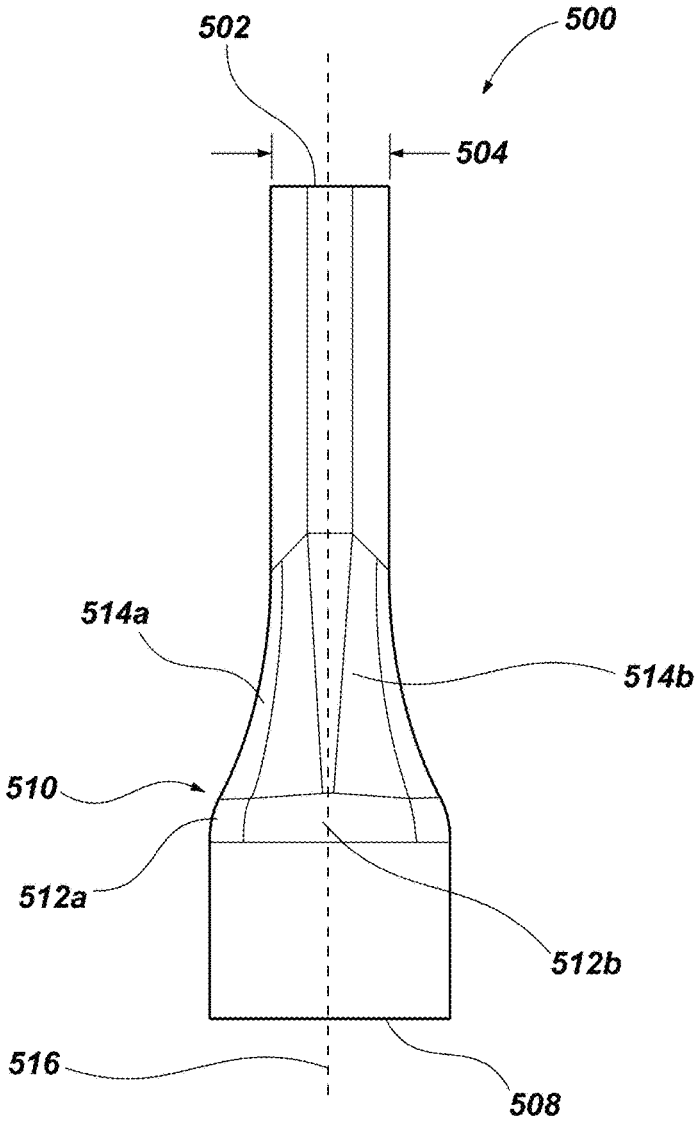
FIG. 5B illustrates a side schematic view of the fluid passage of FIG. 5A.

FIGS. 5A and 5B illustrate different views of a fluid passage 500 having a non-circular outlet 502. In FIGS. 5A and 5B, the outlet 502 is an oval shaped outlet 502 (e.g., a cross-section of the outlet 502 in a direction perpendicular to a longitudinal axis 516 of the fluid passage 500 is substantially oval shaped). The outlet 502 defines a major axis 504 (e.g., larger dimension) and a minor axis 506 (e.g., smaller dimension).

The fluid passage 500 may be configured to transition from the size and shape of the inlet 508 to the size and shape of the outlet 502 in substantially a same distance (e.g., the transition length 414 (FIGS. 4A and 4B)). In embodiments where the inlet 508 has a substantially circular cross-section, the transition region 510 may have a different configuration in areas transitioning from the inlet 508 to the outlet 502 in a region associated with the minor axis 506 of the outlet 502 in relation to the areas transitioning from the inlet 508 to the outlet 502 in a region associated with the major axis 504 of the outlet 502. For example, the transition length (e.g., transition length 414 (FIGS. 4A and 4B)), may increase as a difference between a dimension of the outlet 502 and a respective dimension of the inlet 508 increases. To maintain a substantially uniform transition length in the transition region 510 other features of the transition region 510 may be adjusted.

For example, in the embodiment illustrated in FIG. 5B, the transition region 510 includes a first arc 512*a* and a second arc 514*a* associated with the transition to the major axis 504 of the outlet 502 and a first arc 512*b* and a second arc 514*b* associated with the transition to the minor axis 506 of the outlet 502. At least one of the first arc 512*a* and the second arc 514*a* may have a radius larger than a radius of the respective first arc 512*b* and second arc 514*b*. The larger radius of the at least one of the first arc 512*a* and the second arc 514*a* may increase the transition length (e.g., transition length 414 (FIGS. 4A and 4B)) in the associated transition region 510.

In other embodiments, the radii of the associated first arc 512*a*, first arc 512*b*, second arc 514*a*, and second arc 514*b* may be substantially uniform, such that the transition length changes about the longitudinal axis 516 to accommodate the transition for the change of shape. In yet other embodiments, the inlet 508 may be formed to have a same cross-sectional shape as the outlet 502.

Figure 6A:
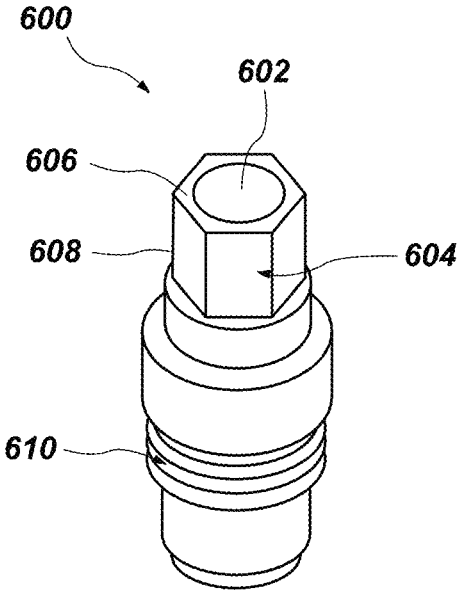
FIGS. 6A through 7 illustrate perspective views of nozzles in accordance with embodiments of the disclosure.
Figure 6B:
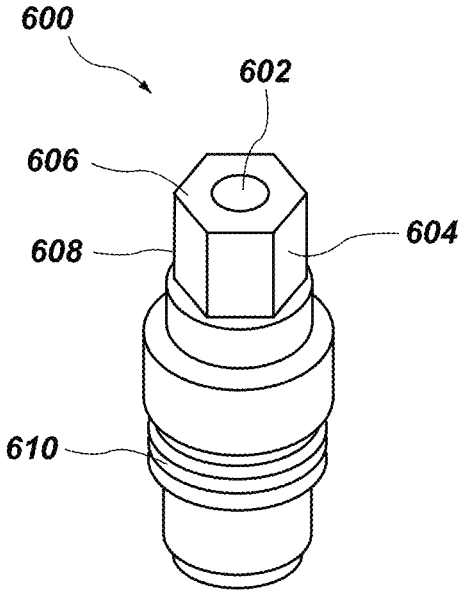

FIGS. 6A and 6B illustrate embodiments of a nozzle 600 (e.g., nozzle 106 (FIG. 1)). The nozzle 600 includes an extension 608 configured to extend the outlet 606 to a position closer to the formation from the mounting location of the nozzle 600 on an associated earth-boring tool (e.g., earth-boring tool 100 (FIGS. 1 through 3)). The outlet 606 includes an orifice 602 coupled to the fluid path defined in the nozzle 600. Different nozzles 600 may have different orifice 602 sizes, as illustrated in FIGS. 6A and 6B. The different orifice 602 sizes may alter flow properties of the fluid passing out of the outlet 606 of the respective nozzles 600. As described above, different orifice sizes and/or shapes may alter properties of the flow of fluid exiting the associated nozzle 600 through the orifice 602. For example, a larger orifice 602, as illustrated in FIG. 6A, may provide a larger volume of fluid at a lower velocity, whereas a smaller orifice 602, as illustrated in FIG. 6B, may provide a smaller volume of fluid at a higher velocity.

In some embodiments, nozzles 600 having different orifice 602 sizes are positioned in different positions about the earth-boring tool, such that the earth-boring tool has different pressure zones. For example, a nozzle 600 having a smaller orifice 602 may be positioned ahead of a first blade and a second nozzle 600 having a larger orifice 602 may be positioned ahead of a second blade. The first nozzle 600 may provide a fluid stream with a higher velocity than the second nozzle 600. As the earth-boring tool rotates the different nozzles 600 may generate an oscillating pressure on the formation.

The nozzles 600 may include tool interfaces 604 on the extension 608 of the nozzle 600. The tool interfaces 604 may facilitate the installation and removal of the nozzle 600. For example, the interfaces 610 on the nozzles 600 may be threads and the tool interfaces 604 on the respective nozzles 600 may facilitate coupling a wrench, socket or other tool to the extension 608 of the nozzle 600 to turn the nozzle 600 engaging the threads of the interface 610 to install or remove the nozzle 600. In some embodiments, the tool interface 604 may be configured to use specialized tooling, such that the nozzles 600 may not be removed without a specialized tool to prevent unauthorized removal of the nozzles 600.

Figure 7:
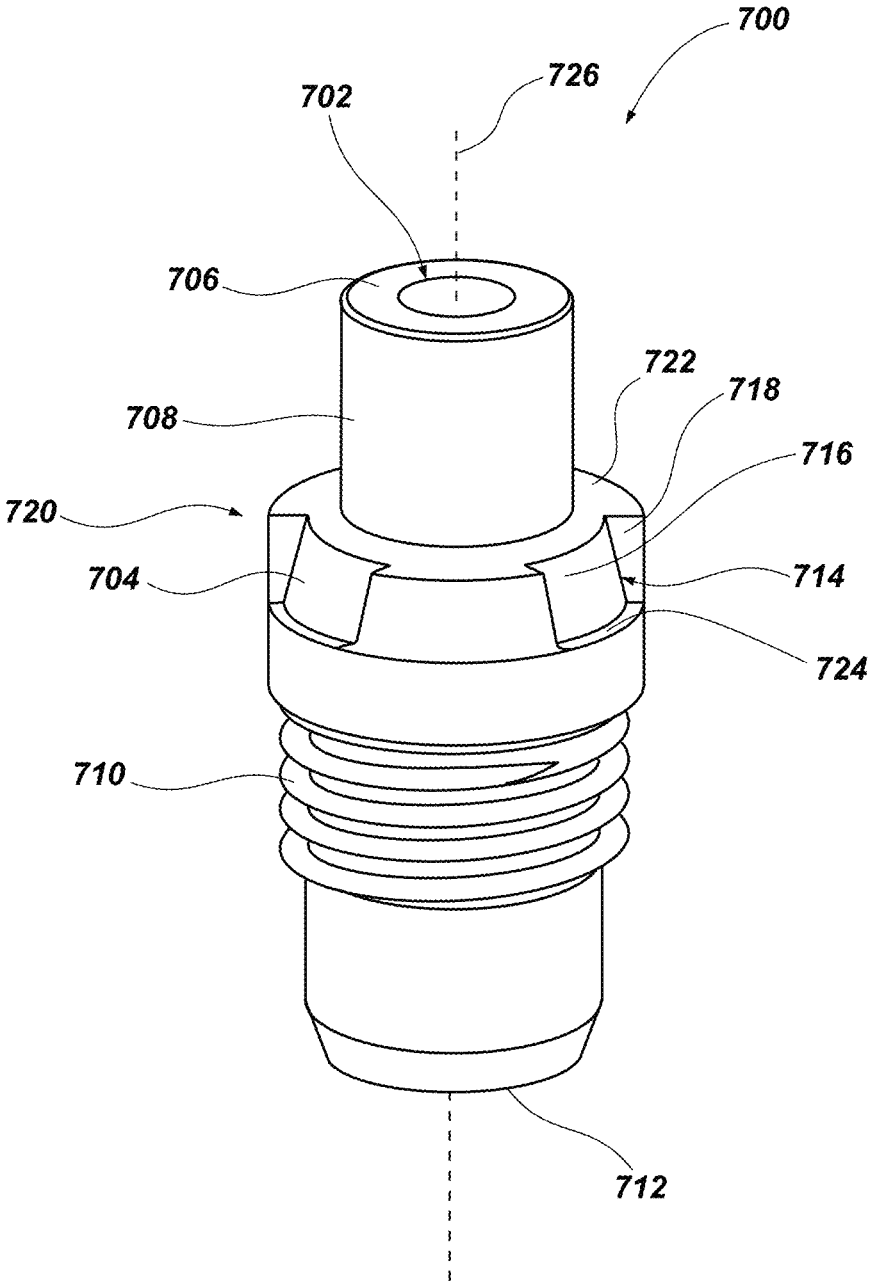

FIG. 7 illustrates a nozzle 700 including a tool interface 704 configured to use specialized tooling. In the embodiment illustrated in FIG. 7, the nozzle 700 includes an outlet 706 with an orifice 702 defined therein and an inlet 712 with a fluid path defined between the inlet 712 and the outlet 706. The nozzle 700 includes an extension 708 configured to position the outlet 706 a distance from an associated mounting point, such as the body of an earth-boring tool (e.g., earth-boring tool 100 (FIGS. 1-3)).

In the embodiment illustrated in FIG. 7, the extension 708 is substantially free of any tooling interface structures. The extension 708 is a substantially circular cylindrical shape with no flat surfaces defined thereon to facilitate an interface with a tool, such as a wrench or socket. The nozzle 700 may include a shoulder 720 extending between an interface 710 of the nozzle 700 and the extension 708. In the embodiment illustrated in FIG. 7, the tool interface 704 is defined in the shoulder 720. The tool interface 704 may include multiple interface structures, such as recesses or protrusions, configured to facilitate an interface with a specialized tool, such as a specialized socket or wrench (e.g., a security socket, keyed socket, security wrench, etc.). In some embodiments, the pattern and shape of the multiple interface structures is defined by an accepted industry standard. In other embodiments, the pattern and shape of the multiple interface structures may be defined by a company standard or a local standard.

In the embodiment illustrated in FIG. 7, the shoulder 720 includes multiple recesses 714 defined in the shoulder 720 that are configured to facilitate an interface with a complementary tool. The recesses 714 may be spaced about the shoulder 720. For example, the recess 714 may be uniformly spaced about the shoulder 720. In another example, the recesses 714 may be non-uniformly spaced about the shoulder 720, such that the complementary tool is configured to interface with the recesses 714 in specific orientations. The recesses 714 include an angled face 716 extending between two barrier walls 718. The angled face 716 may extend at an angle from an upper surface 722 of the shoulder 720 to a base wall 724 of the base wall 724 at an angle away from a longitudinal axis 726 of the nozzle 700, such that a depth of the recess 714 is greater in a region proximate the upper surface 722 of the shoulder 720 than in a region proximate the base wall 724. The base wall 724 may be configured to stop a complementary tool from travelling further down over the extension 708. For example, a complementary protrusion on the complementary tool may rest on the base wall 724 when the complementary tool is fully disposed over the exposed portion of the nozzle 700. The barrier walls 718 may be configured to interface with the complementary tool (e.g., the complementary protrusion of the complementary tool). For example, as discussed above, the interface 710 may be threads configured to secure or release the nozzle 700 from the mounting point, such as the body of an earth-boring tool through a rotating motion. The complementary tool may apply a force to the barrier wall 718 on a first side of the recess 714 to cause the nozzle 700 to rotate in a first direction and the complementary tool may apply a force to the barrier wall 718 on a second opposite side of the recess 714 to cause the nozzle 700 to rotate in a second opposite direction.

Embodiments of the present disclosure may facilitate improved flow control through nozzles in an earth-boring tool. Improved flow control may increase an impact force and formation penetration of fluid flowing from the nozzles. This may cause the pore pressure in a formation to be artificially increased in a controlled area. Increasing the pore pressure of the formation may reduce the forces required to shear the formation and remove the material from the formation. This may reduce the power required to remove the material, reducing the power used in a drilling operation and/or increasing the speed with which the drilling may be performed.

Controlling the area where the pore pressure of the formation is artificially increased may enable a drilling operation to maintain the integrity of the wellbore through overbalanced drilling in the majority of the wellbore, while weakening the wall of the wellbore in a localized area to increase the efficiency of the material removal process. Increasing the efficiency of the material removal process may reduce the cost of drilling a wellbore. Increasing the efficiency of the material removal process may further reduce the amount of time before a wellbore may begin production and become a profitable wellbore.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A nozzle for use in an earth-boring tool, the nozzle comprising:

a nozzle body, surfaces of the nozzle body defining:

an inlet having a first dimension;

an outlet having a second dimension different from the first dimension of the inlet, the outlet having a transverse cross-sectional shape; and a fluid passage defined in the nozzle extending from the inlet to the outlet, the nozzle body comprising:

a transition region configured to transition the fluid passage from the first dimension of the inlet to the second dimension of the outlet, the transition region comprising:

a first frustoconical surface, a longitudinal cross-section of the first frustoconical surface exhibiting a first arcuate shape curving inward; and a second frustoconical surface, a longitudinal cross-section of the second frustoconical surface exhibiting a second arcuate shape curving outward; and an outlet region extending from the transition region to the outlet, the fluid passage in the outlet region having a substantially uniform transverse cross-sectional shape that is substantially the same as the transverse cross-sectional shape of the outlet throughout the outlet region, the outlet region having a length in a range from about 1 times the second dimension of the outlet to about 5 times the second dimension of the outlet.

2. The nozzle of claim 1, wherein the first arcuate shape has a first radius and the second arcuate shape has a second radius.

3. The nozzle of claim 2, wherein the first radius is substantially the same as the second radius.

4. The nozzle of claim 2, wherein a ratio of the second size of the outlet to the first radius of the first arcuate shape is in a range from about 2 to about 10.

5. The nozzle of claim 1, wherein the transition region includes an intermediate transition point where the first arcuate shape transitions to the second arcuate shape, wherein the first arcuate shape and the second arcuate shape have a tangential relationship at the intermediate transition point.

6. The nozzle of claim 1, wherein the transition region is defined between an inlet transition point wherein the inlet transitions to the first arcuate shape and an outlet transition point where the second arcuate shape transitions to the outlet region.

7. The nozzle of claim 6, wherein the first arcuate shape has a tangential relationship with the inlet at the inlet transition point and wherein the second arcuate shape has a tangential relationship with the outlet region at the outlet transition point.

8. The nozzle of claim 6, wherein a transition length is defined between the inlet transition point and the outlet transition point.

9. The nozzle of claim 8, wherein the transition length is between about ¼ and about ¾ of a total length of the fluid passage.

10. The nozzle of claim 1, wherein the inlet has a first shape and the outlet has a second shape different from the first shape, wherein the transition region is configured to transition the fluid passage from the first shape of the inlet to the second shape of the outlet.

11. An earth-boring tool comprising:

at least one blade including at least one cutting element;

at least one fluid course positioned adjacent the at least one blade; and a nozzle positioned in the at least one fluid course, the nozzle comprising:

a nozzle body, surfaces of the nozzle body defining:

an inlet having a first dimension;

an outlet having a second dimension different from the first dimension of the inlet, the outlet having a transverse cross-sectional shape; and a fluid passage defined in the nozzle extending from the inlet to the outlet, the nozzle body comprising a transition region configured to transition the fluid passage from the first dimension of the inlet to the second dimension of the outlet, the transition region comprising:

an inlet transition point where a cross-section of the fluid passage begins to transition from the first size of the inlet;

an outlet transition point, where the cross-section of the fluid passage finishes transitioning to the second size of the outlet;

a transition length defined between the inlet transition point and the outlet transition point, where the transition length is between about ¼ and about ¾ of a total length of the fluid passage, wherein the transition length includes a first frustoconical surface exhibiting a first arcuate shape curving inward and a second frustoconical surface exhibiting a second arcuate shape curving outward; and an outlet region extending from the outlet transition point to the outlet, the outlet region having a substantially uniform transverse cross-sectional shape that is substantially the same as the transverse cross-sectional shape of the outlet throughout the outlet region, the outlet region having a length in a range from about 1 times the second dimension of the outlet to about 5 times the second dimension of the outlet.

12. The earth-boring tool of claim 11, wherein the fluid passage has a substantially tangential relationship at the inlet transition point.

13. The earth-boring tool of claim 11, wherein the fluid passage has a substantially tangential relationship at the outlet transition point.

14. The earth-boring tool of claim 11, wherein the nozzle further comprises a shoulder region including multiple spaced recesses configured to interface with specialized tooling for removing or installing the nozzle.

15. A method of forming a nozzle for an earth-boring tool, the method comprising:

forming a nozzle structure including an interface structure and an extension extending from the interface structure;

forming an inlet in the nozzle structure having a first dimension;

forming an outlet in the nozzle structure axially aligned with the inlet, the outlet having a second dimension different from the first dimension, the outlet having a transverse cross-sectional shape;

forming a fluid passage between the inlet and the outlet, the fluid passage extending axially through the nozzle structure;

forming a transition region in the fluid passage, the transition region configured to transition the fluid passage from the first dimension of the inlet to the second dimension of the outlet, the transition region including:

a first frustoconical surface, a longitudinal cross-section of the first frustoconical surface defining a first arc curving inward; and a second frustoconical surface, a longitudinal cross-section of the second frustoconical surface defining a second arc curving outward; and outward; and forming an outlet region in the fluid passage extending from the transition region to the outlet, the fluid passage in the outlet region having a substantially uniform transverse cross-sectional shape that is substantially the same as the transverse cross-sectional shape of the outlet throughout the outlet region, the outlet region having a length in a range from about 1 times the second dimension of the outlet to about 5 times the second dimension of the outlet.

16. The method of claim 15, wherein forming the transition region in the fluid passage comprises forming complex structures through additive manufacturing.

17. The method of claim 15, wherein forming the nozzle structure comprises forming one or more portions of the nozzle structure through a forging or sintering process.

* * * * *